US006837526B2

(12) United States Patent
Markbreit

(10) Patent No.: US 6,837,526 B2
(45) Date of Patent: Jan. 4, 2005

(54) ADJUSTABLE DEADBOLT

(75) Inventor: Dani Markbreit, Azor (IL)

(73) Assignee: Mul-T-Lock Technologies Ltd., Yavne (IL)

( * ) Notice: Subject to any disclaimer, the term of this patent is extended or adjusted under 35 U.S.C. 154(b) by 191 days.

(21) Appl. No.: 09/910,528

(22) Filed: Jul. 20, 2001

(65) Prior Publication Data

US 2002/0008390 A1 Jan. 24, 2002

(30) Foreign Application Priority Data

Jul. 21, 2000 (IL) ..... 137434
Mar. 23, 2001 (IL) ..... 142226

(51) Int. Cl.[7] ..... E05C 1/16
(52) U.S. Cl. ..... 292/1.5; 292/DIG. 60; 292/337
(58) Field of Search ..... 292/1.5, 169, DIG. 60, 292/336.5, 337, 2, 37

(56) References Cited

U.S. PATENT DOCUMENTS 3,142,506 A * 7/1964 Maurits et al.
4,372,594 A * 2/1983 Bovio et al. ..... 361/680
4,671,549 A * 6/1987 Marotto et al. ..... 292/1.5
5,039,146 A * 8/1991 Lin ..... 292/244
5,456,503 A * 10/1995 Russell, IV ..... 292/1.5
5,474,346 A * 12/1995 Fann et al. ..... 292/337
5,769,472 A * 6/1998 Small ..... 292/1.5
5,944,366 A * 8/1999 Aramburu ..... 292/1.5
5,957,510 A * 9/1999 Kuo ..... 292/1.5
6,318,769 B1 * 11/2001 Kang ..... 292/1.5
6,401,297 B1 * 6/2002 Huang ..... 16/337

* cited by examiner

*Primary Examiner*—Gary Estremsky
*Assistant Examiner*—Mark Williams
(74) *Attorney, Agent, or Firm*—The Maxham Firm

(57) ABSTRACT

An adjustable deadbolt assembly including a deadbolt, a cylinder-connecting portion formed with mounting provisions for mounting thereto, a lock cylinder, an actuator formed with a hub connectable to a lock cylinder, the hub being journaled in the cylinder-connecting portion and a link bar that connects the actuator to the deadbolt at at least one of a plurality of attachment points formed on at least one of the deadbolt and the link bar. A method for adjusting an adjustable deadbolt assembly is also disclosed.

13 Claims, 9 Drawing Sheets

ADJUSTABLE DEADBOLT

FIELD OF THE INVENTION

The present invention relates generally to deadbolt assemblies and particularly to an extendable deadbolt, which can extend from one standard size to another, a deadbolt assembly having a pivotable faceplate and a deadbolt assembly suitable for use with doors of varying thickness.

BACKGROUND OF THE INVENTION

Many kinds of deadbolt assemblies are commercially available. Deadbolts are thrown and retracted by means of a key-operated cylinder which passes through a hub of the deadbolt assembly. Turning the key turns the hub, which causes a cam or actuator to throw or retract the bolt. Some deadbolts are operated by a single cylinder, wherein the deadbolt is actuated by a key from outside the door and by a turnpiece from inside the door. Other deadbolts are operated by a double cylinder, wherein the deadbolt is thrown or retracted by a key from both sides of the door.

Deadbolts are thrown and retracted into a doorpost through a metal plate called a strike. The distance between the strike and the center of the hub is called the backset. In the United States, standard backsets are generally 2.375 inches or 2.75 inches. The throw of the deadbolt varies from one lock to another, with the maximum generally being 1 inch.

Most deadbolts are fixed at one standard backset or another. However, deadbolts with an adjustable backset are known. For example, KWIKSET manufactures and sells a deadbolt with a helical screw body (for example, its 880 series). By turning the strike, one can change the backset from 2.375 to 2.75 inches, and vice versa. SCHLAGE manufactures a line of deadbolts (B160 Grade 3 deadbolts) wherein the hub can be slid from one end of an elliptical hole to another, thereby adjusting the backset from one standard size to another.

However, adjustable-backset deadbolts of the art suffer from a drawback of a relatively weak mechanical connection between the deadbolt and the hub end of the assembly. This makes adjustable-backset deadbolts generally unsuitable for high security installations. In addition, the spacing between mounting screws used to mount the key-operated cylinder to the deadbolt assembly are not standard in prior art adjustable-backset assemblies.

Generally, deadbolt assemblies are not particularly flexible when non standard applications are required. For example, when conventional deadbolt assemblies are mounted on bevel-mounted doors, the faceplates must be specially enlarged and specially aligned to match the particular application. Similarly, when conventional deadbolt assemblies are mounted on doors of non-standard thickness, special hardware must be used.

SUMMARY OF THE INVENTION

The present invention seeks to provide a novel deadbolt with an adjustable backset wherein there is a positive and strong mechanical link at all times between the deadbolt and the hub end of the deadbolt assembly. The deadbolt itself extends all the way to a mounting screw used to mount the key-operated cylinder to the deadbolt assembly. This is in contrast to prior art deadbolt assemblies which have shorter deadbolts. The longer deadbolt provides added strength against break-in attempts. Moreover, in the present invention, unlike the prior art, the spacing between mounting screws used to mount the key-operated cylinder to the deadbolt assembly is standard.

There is thus provided in accordance with a preferred embodiment of the present invention an adjustable deadbolt assembly including a deadbolt, a cylinder-connecting portion formed with mounting provisions for mounting thereto a lock cylinder, an actuator formed with a hub connectable to a lock cylinder, the hub being journaled in the cylinder-connecting portion, and a link bar that connects the actuator to the deadbolt at at least one of a plurality of attachment points formed on at least one of the deadbolt and the link bar. The attachment points may be notches formed on a periphery of the deadbolt or on the link bar.

In accordance with a preferred embodiment of the present invention the deadbolt is slidingly disposed in a tube, and the cylinder-connecting portion, the link bar, the actuator and the deadbolt are selectively removable from the tube.

Further in accordance with a preferred embodiment of the present invention a pin is placed between the tube and the cylinder-connecting portion, the pin being pushable inwards into a hole formed in the cylinder-connecting portion so as to release the tube from the cylinder-connecting portion, thereby permitting withdrawing the cylinder-connecting portion, the actuator, the link bar and the deadbolt from the tube.

Still further in accordance with a preferred embodiment of the present invention the deadbolt has a length such that the deadbolt extends to one of the mounting provisions when the link bar fits into one of the notches formed on the deadbolt.

Additionally in accordance with a preferred embodiment of the present invention the mounting provisions are mounting holes spaced from one another corresponding to a spacing between mounting screws of a lock cylinder.

In accordance with a preferred embodiment of the present invention a strike is attached to the tube wherein a distance, called a backset, between an outer surface of the strike and a center of the hub is defined by the notch in which the link bar is fitted. Preferably the backset varies from about 2.375 inches to about 2.75 inches.

There is also provided in accordance with a preferred embodiment of the present invention a method for adjusting an adjustable deadbolt assembly including withdrawing the cylinder-connecting portion, the link bar, the actuator and the deadbolt from the tube, moving the link bar from one attachment point to another, and sliding the cylinder-connecting portion, the link bar, the actuator and the deadbolt back into the tube.

There is also provided in accordance with a preferred embodiment of the present invention a deadbolt assembly including a deadbolt, a tube in which the deadbolt is slidingly disposed including an end through which said deadbolt emerges when extended, and a faceplate pivotably connected to an end of the tube. The deadbolt assembly may be but need not necessarily be an adjustable deadbolt assembly of the type described hereinabove.

BRIEF DESCRIPTION OF THE DRAWINGS

The present invention will be understood and appreciated more fully from the following detailed description, taken in conjunction with the drawings in which:

FIGS. 6 and 7 are simplified sectional illustrations of the relatively short backset position shown in FIG. 4, wherein FIG. 6 is taken along lines VI—VI in FIG. 4 and FIG. 7 is taken along lines VII—VII in FIG. 6;

FIGS. 8 and 9 are simplified sectional illustrations of the relatively long backset position shown in FIG. 5, wherein FIG. 8 is taken along lines VIII—VIII in FIG. 5 and FIG. 9 is taken along lines IX—IX in FIG. 8;

DETAILED DESCRIPTION OF PREFERRED EMBODIMENTS

Figure 1:
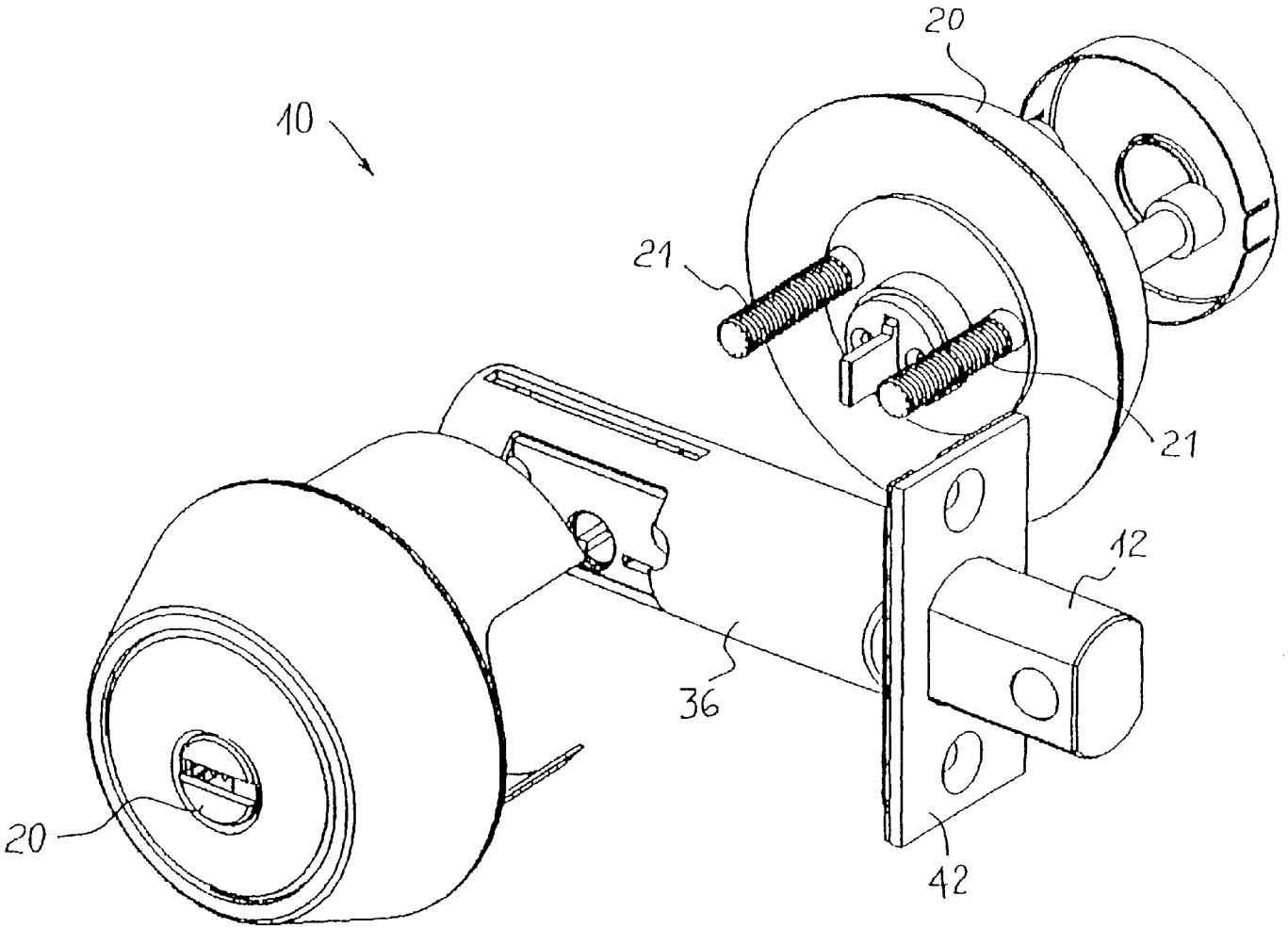
FIGS. 1 and 2 are simplified exploded and pictorial illustrations, respectively, of an adjustable deadbolt assembly constructed and operative in accordance with a preferred embodiment of the present invention.
Figure 2:
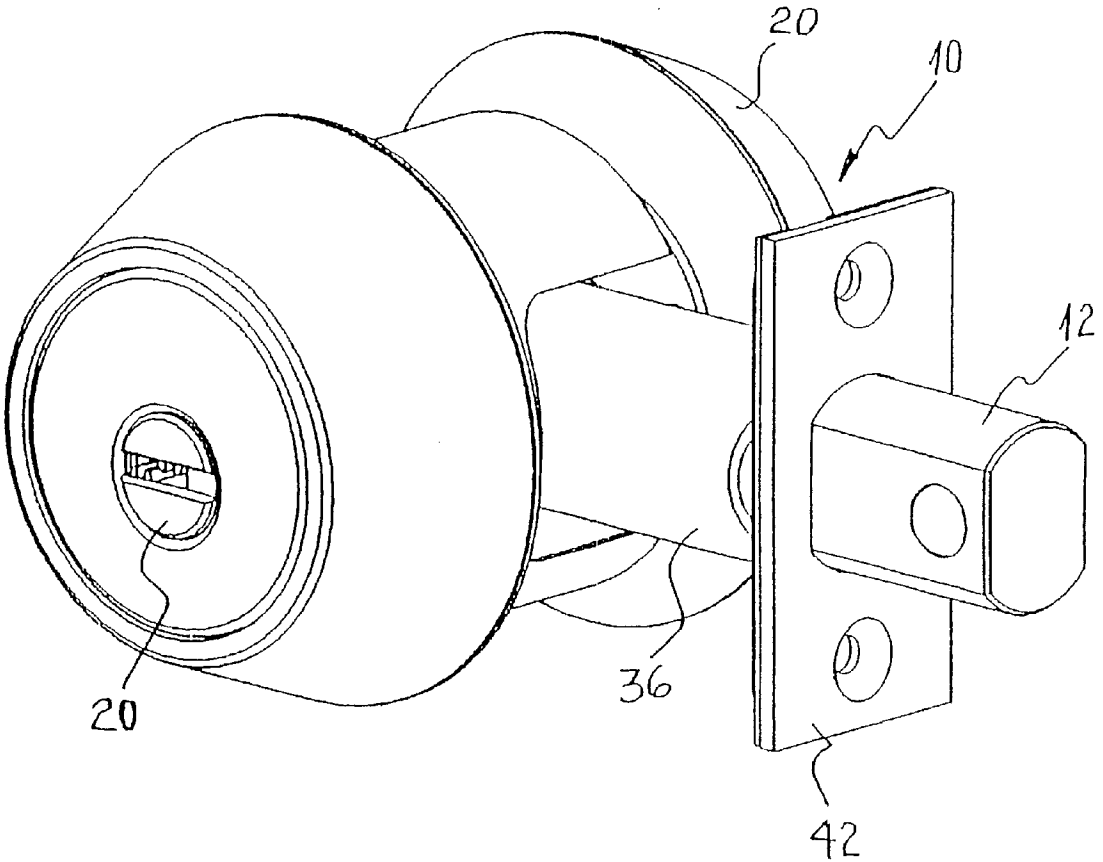
Figure 3:
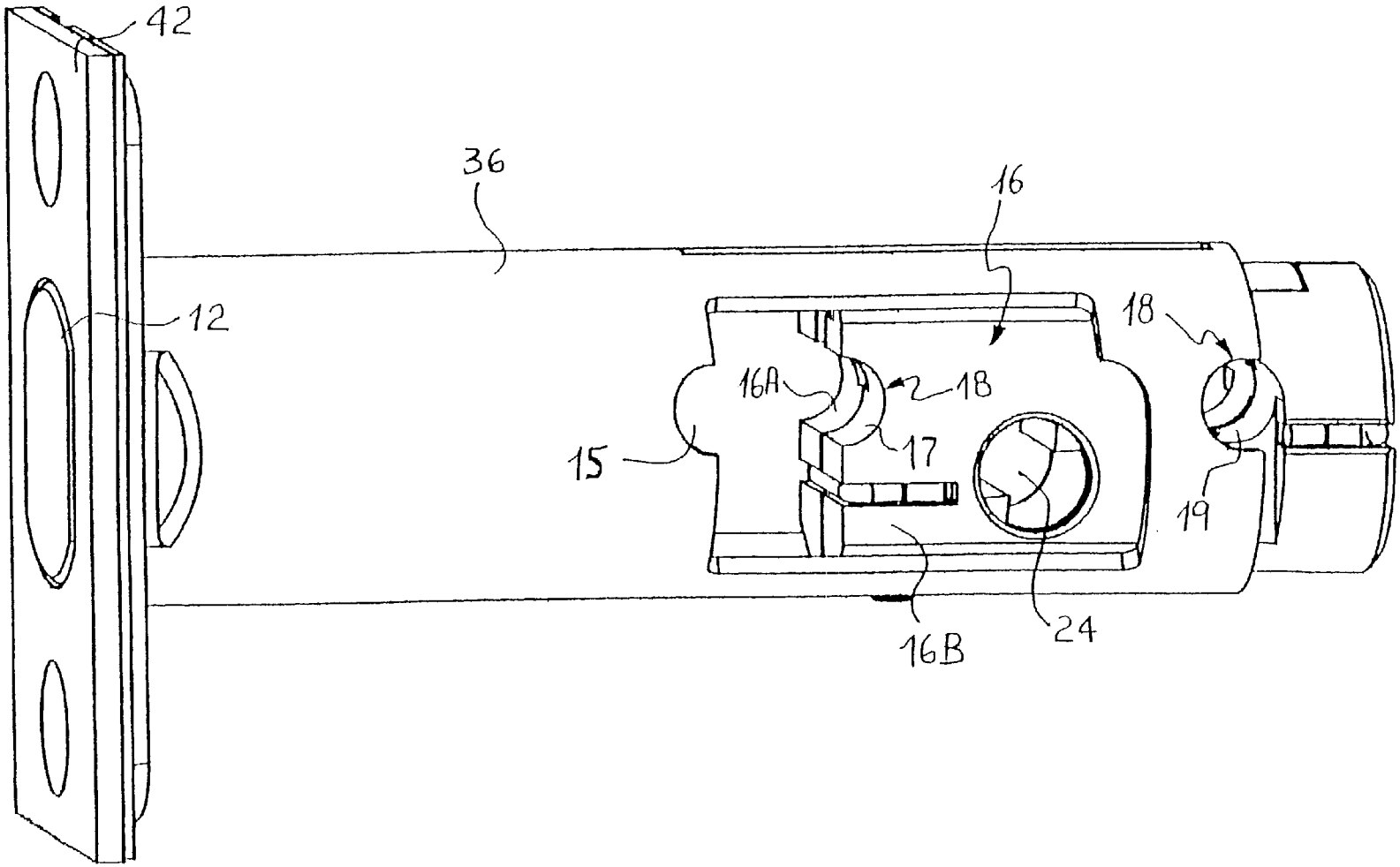
FIG. 3 is a simplified pictorial illustration of a deadbolt in a tube, which forms part of the adjustable deadbolt assembly of FIGS. 1 and 2.

Reference is now made to FIGS. 1–9 which illustrate an adjustable deadbolt assembly 10 constructed and operative in accordance with a preferred embodiment of the present invention.

Deadbolt assembly 10 preferably includes a deadbolt 12 formed with a plurality of notches 14 on a periphery thereof. Two such notches 14 are shown in the illustrated embodiment (FIGS. 4–6 and 8), but it is appreciated that the invention is not limited to this number of notches. Assembly 10 also preferably includes a cylinder-connecting portion 16 formed with mounting provisions 18 for mounting thereto a lock cylinder 20. Lock cylinder 20 is shown as a double cylinder, wherein deadbolt 12 is thrown or retracted by a key (not shown) from both sides of a door (not shown). However, it is appreciated that other arrangements, such as a single cylinder, may also be used.

Mounting provisions 18 are preferably mounting holes 17 and 19 (FIGS. 3–5) which are spaced from one another corresponding to a spacing between mounting screws 21 of lock cylinder 20 (FIG. 1). It is noted that in the illustrated embodiment, mounting hole 17 is formed as a half hole, and deadbolt 12 is preferably formed with a half hole 15. As described hereinbelow with reference to FIG. 6, when deadbolt 12 is placed in a short backset position, half holes 15 and 17 form a complete hole.

Figure 7:
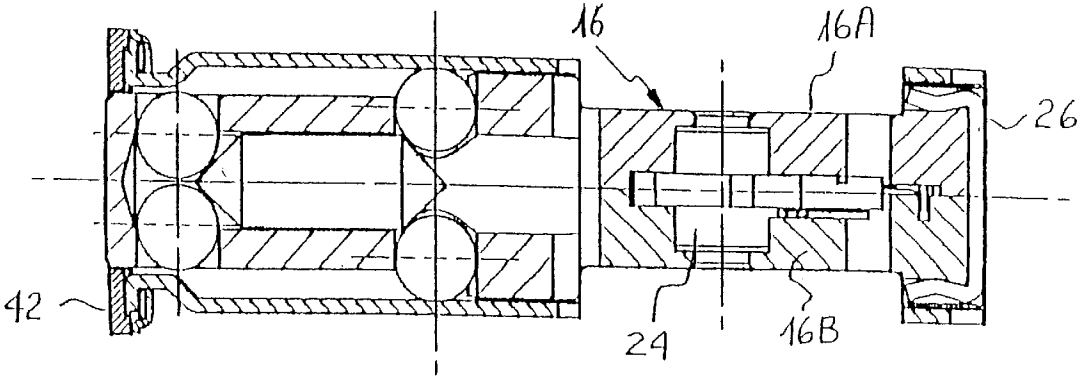
Figure 9:
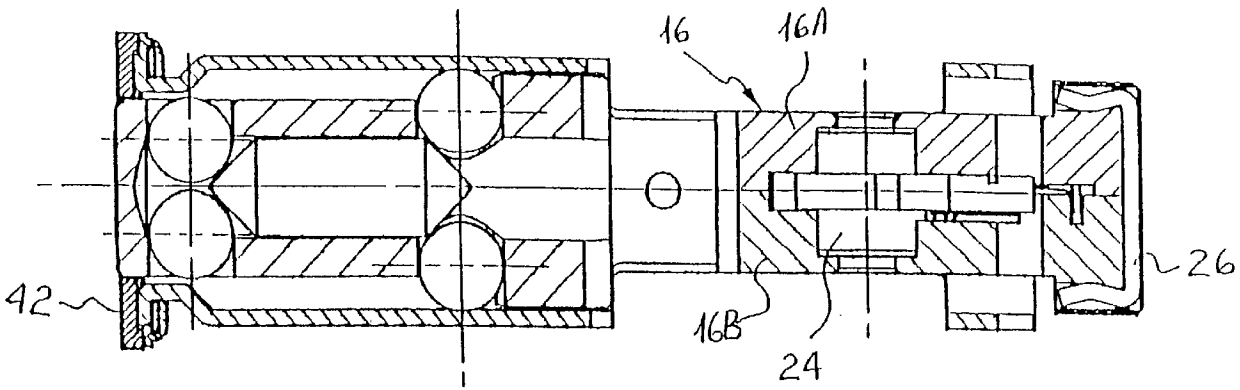

An actuator 22 is preferably formed with a hub 24 into which lock cylinder 20 is connected, as is known in the art. Hub 24 is preferably journaled in cylinder-connecting portion 16. Cylinder-connecting portion 16 may be formed of two halves 16A and 16B, secured by a fastener such as a retaining clip 26, for example (FIGS. 7 and 9). A link bar 28 preferably connects actuator 22 to deadbolt 12. Link bar 28 is preferably formed with an aperture 30 in which is received a portion of actuator 22, such as a tongue 32. An end 34 of link bar 28 is preferably adapted to fit into one of notches 14 formed on deadbolt 12. Alternatively, as shown in dotted lines in FIG. 4, notches 14 may be formed on link bar 28 and deadbolt 12 may be formed with protrusions 33 which are received in one of the notches formed on link bar 28. In general, link bar 28 connects actuator 22 to deadbolt 12 at one of a plurality of attachment points formed on either deadbolt 12 or link bar 28.

Deadbolt 12 is preferably disposed in a tube 36. Tube 36 is preferably connected to the rest of assembly 10 by means of a pin 38, which is preferably spring-loaded by a spring 40. A strike 42 is preferably attached to tube 36. The distance (backset) between an outer surface of strike 42 and a center of hub 24 is defined by the notch 14 in which link bar 28 is fitted.

Figure 4:
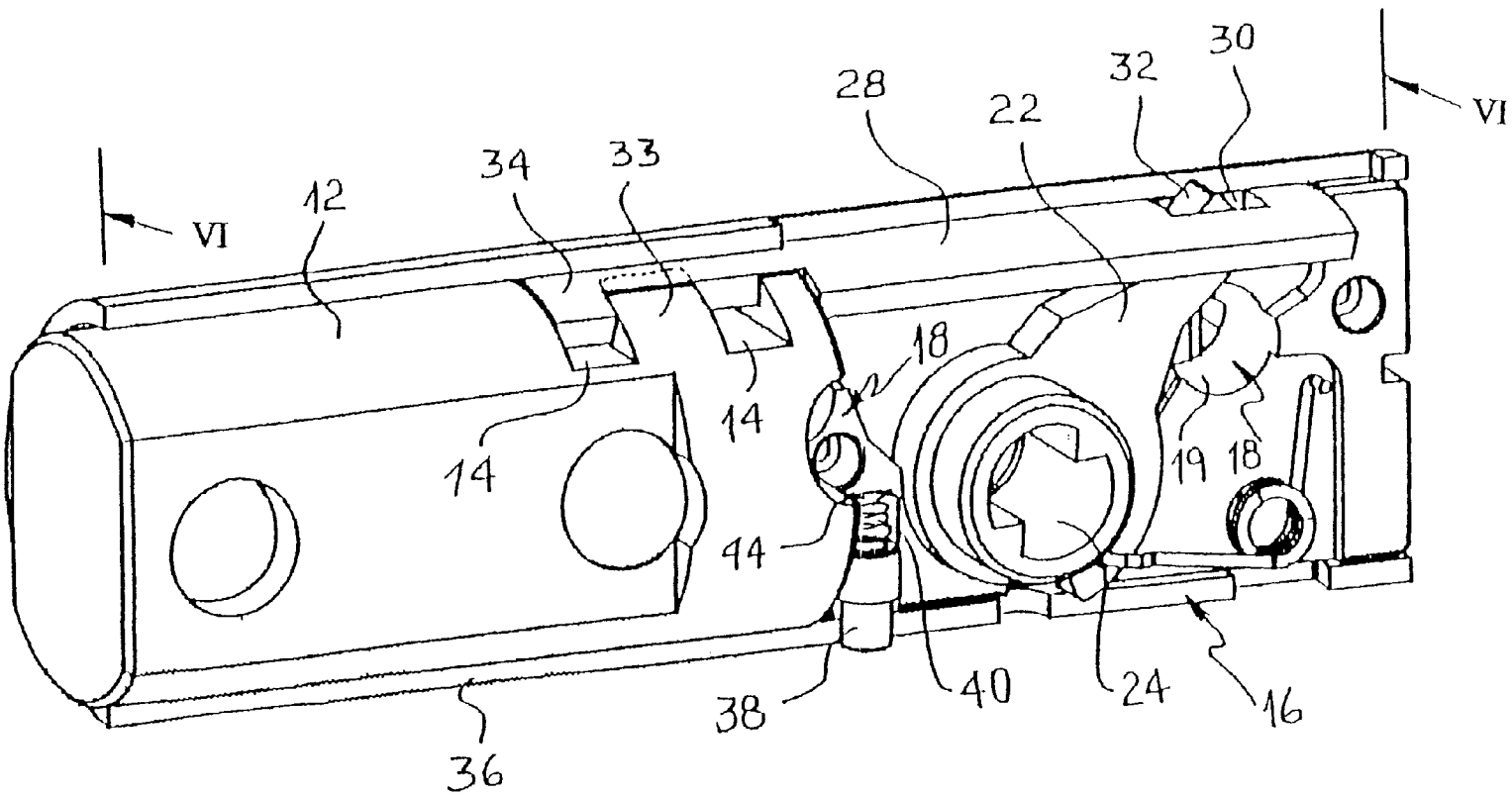
FIGS. 4 and 5 are simplified pictorial illustrations of the deadbolt and an actuator in respective relatively short and relatively long backset positions.
Figure 5:
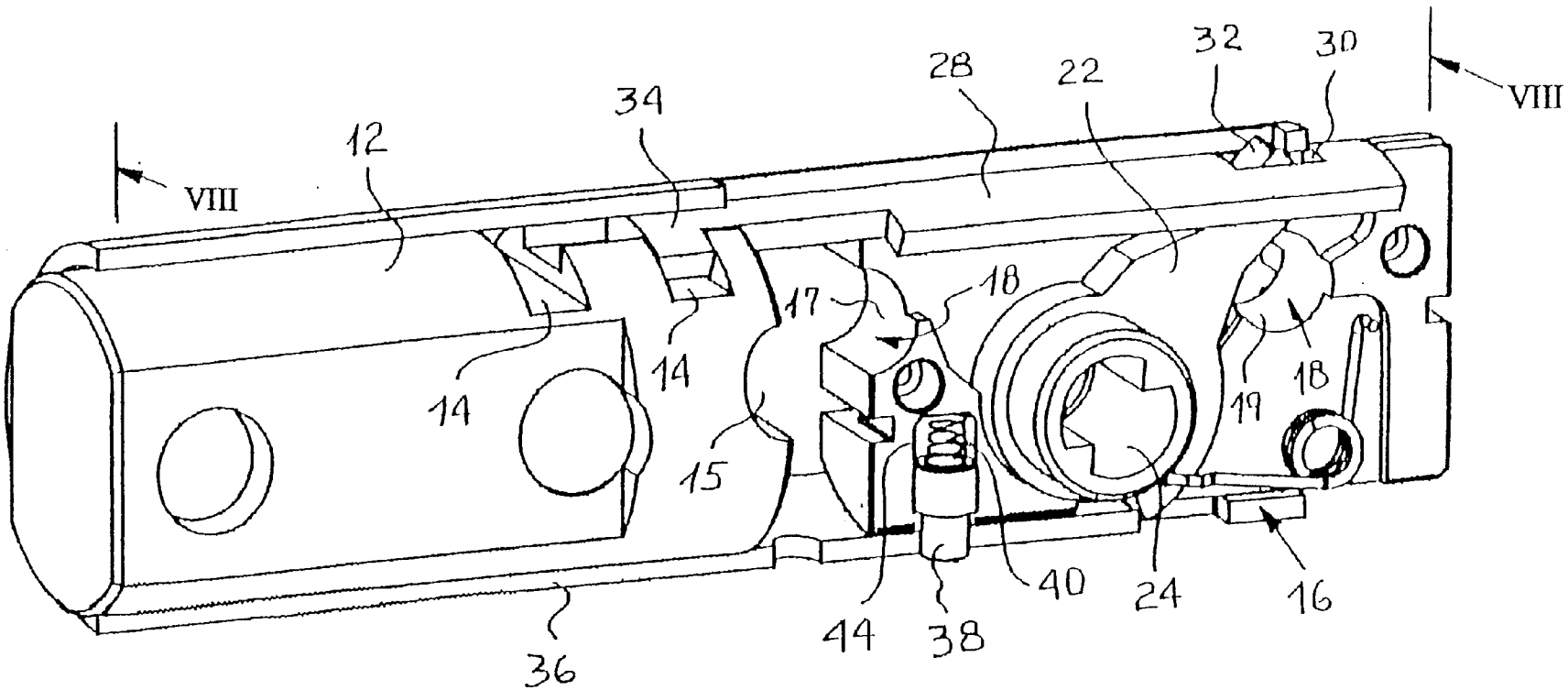
Figure 6:
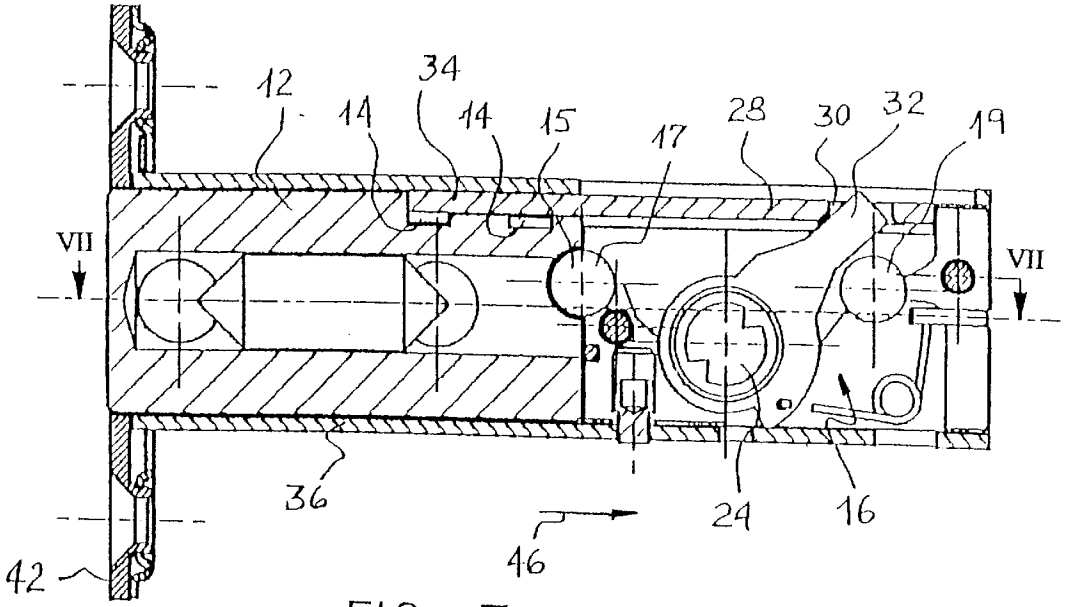
Figure 8:
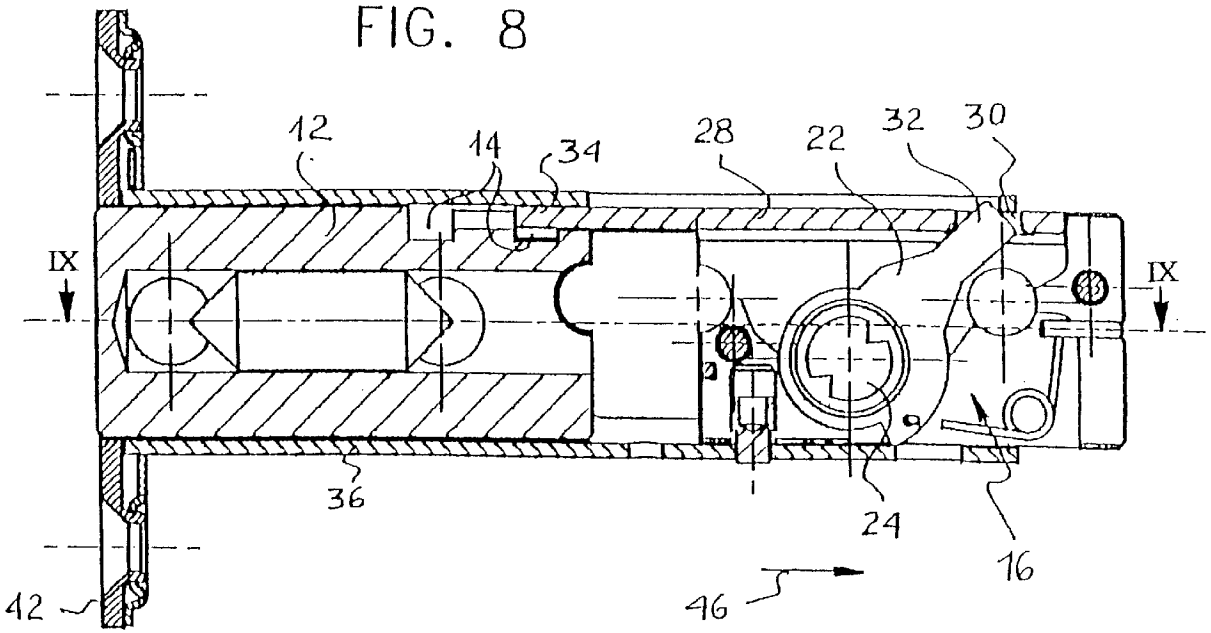

In order to change the backset of deadbolt assembly 10, pin 38 is pushed inwards (against spring 40) into a hole 44 (FIGS. 4 and 5) formed in cylinder-connecting portion 16 so as to release tube 36 from cylinder-connecting portion 16. This permits withdrawing and removing cylinder-connecting portion 16, actuator 22, link bar 28 and deadbolt 12 from tube 36, generally in the direction of an arrow 46 (FIGS. 6 and 8). Link bar 28 may now be moved from one of notch 14 to another. If link bar 28 is fitted in the notch 14 closest to strike 42, then the backset is relatively short (FIGS. 4, 6 and 7). Conversely, if link bar is fitted in the notch 14 furthest from strike 42, then the backset is relatively long (FIGS. 5, 8 and 9). Afterwards, cylinder-connecting portion 16, link bar 28, actuator 22 and deadbolt 12 are slid back into tube 36.

It is noted that deadbolt 12 preferably has a length such that it extends to one of mounting provisions 18 when link bar 28 is adjusted to the shorter backset, as seen best in FIG. 6. In this position, half holes 15 and 17 form a complete hole.

In accordance with American industry standards, the backset of the present invention preferably varies from about 2.375 inches to about 2.75 inches. Of course, other dimensions are also in the scope of the invention.

Figure 10:
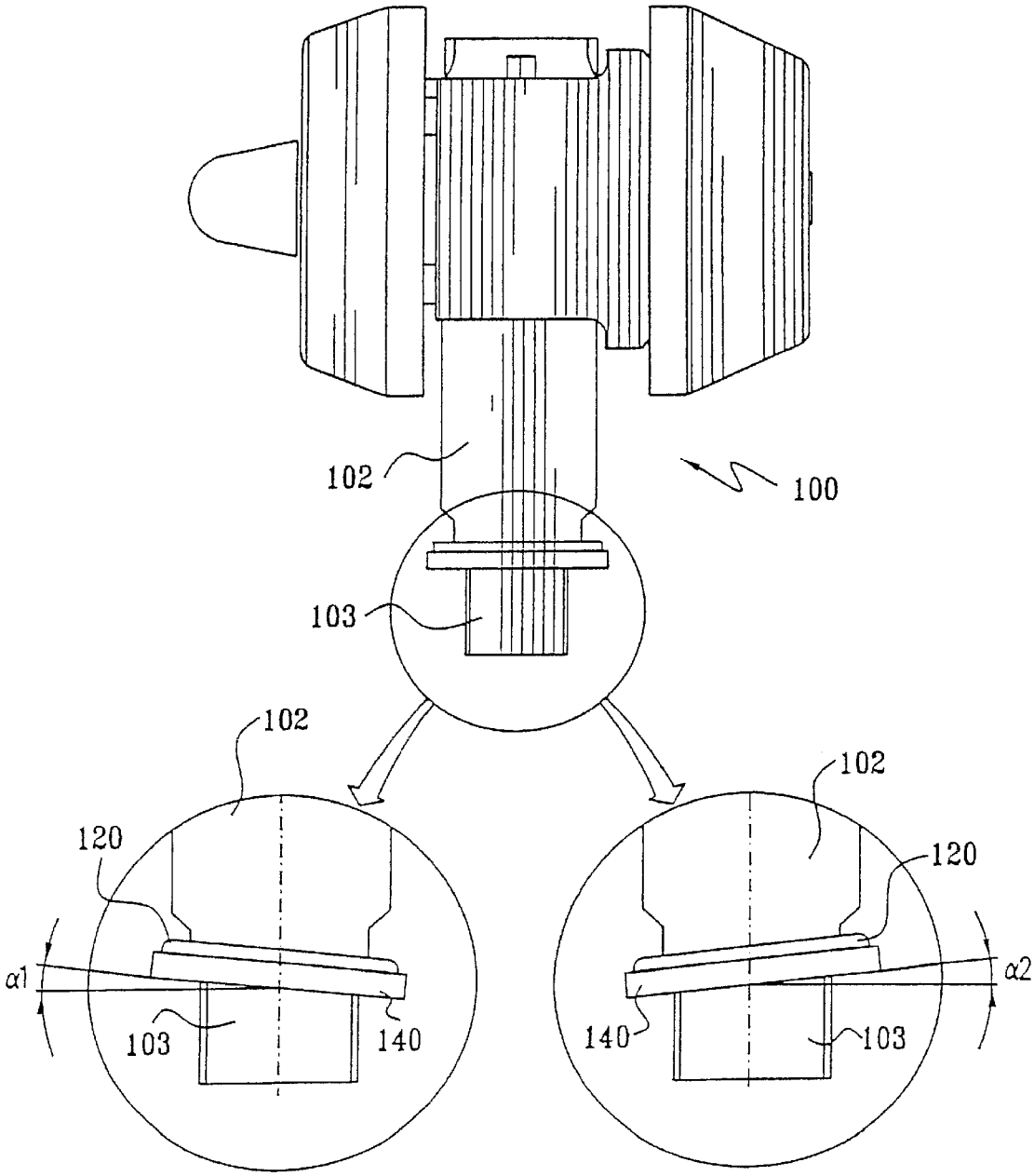
FIG. 10 is a simplified pictorial illustration of a deadbolt assembly having a pivotably mounted faceplate in accordance with a preferred embodiment of the present invention and illustrating three different orientations of the faceplate.
Figure 11:
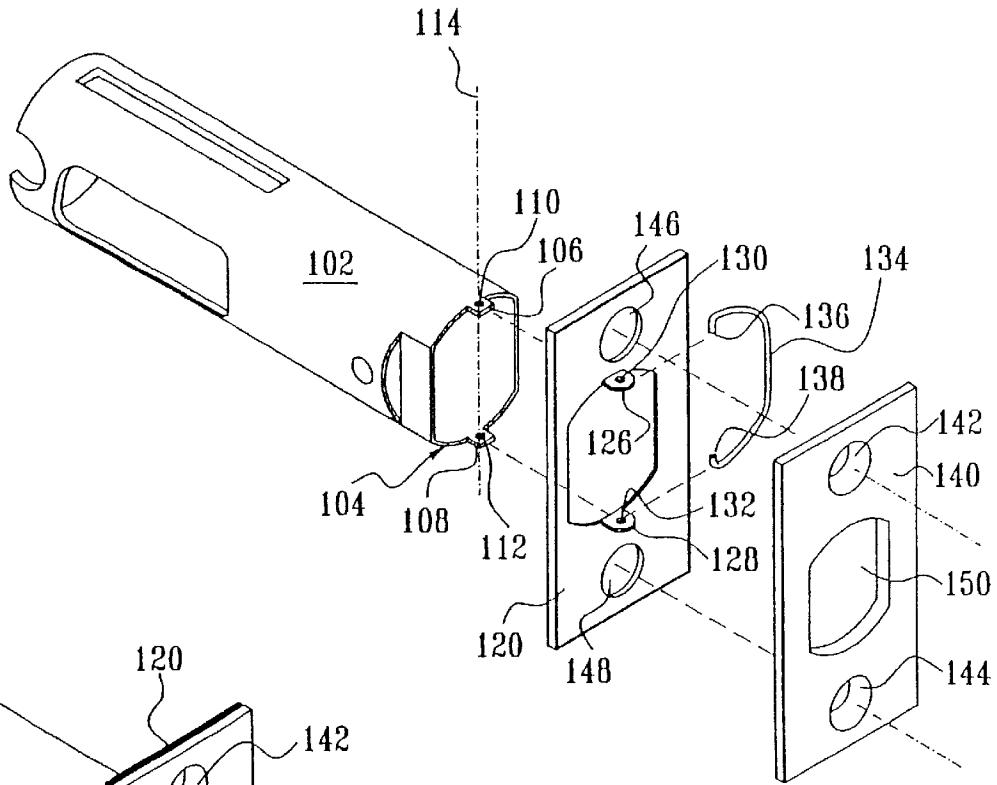
FIG. 11 is an exploded view of part of the deadbolt assembly of FIG. 10, showing a preferred embodiment of pivotably mounted faceplate.
Figure 12:
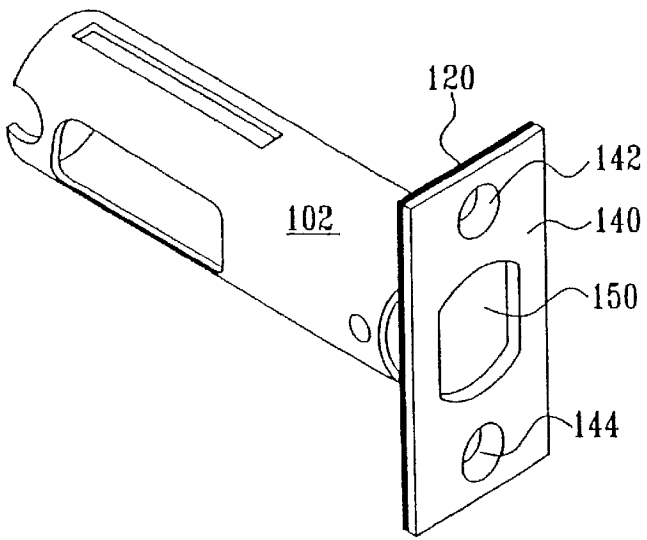
FIG. 12 is an assembled view of the part of the deadbolt assembly shown in FIG. 11.

Reference is now made to FIG. 10, which is a simplified pictorial illustration of a deadbolt assembly having a pivotably mounted faceplate in accordance with a preferred embodiment of the present invention and illustrating three different orientations of the faceplate and to FIGS. 11 and 12, which show details of the pivotable mounting of the faceplate.

As seen in FIGS. 10–12, there is provided a deadbolt assembly 100, which may be, but need not necessarily be, of the type described hereinabove with reference to FIGS. 1–9. The deadbolt assembly 100 includes inter alia a tube 102 through which a bolt 103 is slidably displaceable.

In the illustrated embodiment, a forward end 104 of tube 102 is formed with a pair of oppositely disposed apertured lugs 106 and 108 having formed therein respective apertures 110 and 112. Preferably, the lugs 106 and 108 are positioned such that when the deadbolt assembly 100 is mounted onto a door, apertures 110 and 112 lie along a vertical axis 114.

In the illustrated embodiment, a mounting plate 120 is pivotably mounted onto tube 102, preferably for pivotable mounting about the vertical axis 114 (FIG. 10). Preferably, the mounting plate 120 is formed with mounting lugs 126 and 128 having formed therein respective apertures 130 and 132.

A retaining spring 134 having respective engagement ends 136 and 138 is arranged to pivotably retain mounting plate 120 onto tube 102. End 136 extends through respective apertures 110 and 130 of respective lugs 106 and 126, while end 138 extends through respective apertures 130 and 132 of respective lugs 108 and 128, thus defining pivot axles both of which preferably extend along vertical axis 114.

A face plate 140, to which is attached the mounting plate 120, is readily screwed onto an edge of a door (not shown)

by means of mutually alignable screw holes 142 and 144 in the face plate which correspond to screw holes 146 and 148 in the mounting plate 120.

It is appreciated that the arrangement of FIGS. 10–12 is particularly helpful when mounting a deadbolt assembly on a door, which is hung in a bevel arrangement and ensures that the faceplate 140 is centered relative to the deadbolt. In this way, a deadbolt aperture 150 in the faceplate 140 may be made as small as possible.

It will be appreciated by persons skilled in the art that the present invention is not limited by what has been particularly shown and described hereinabove. Rather the scope of the present invention includes both combinations and subcombinations of the features described hereinabove as well as modifications and variations thereof which would occur to a person of skill in the art upon reading the foregoing description and which are not in the prior art.

What is claimed is:

1. An adjustable deadbolt assembly comprising:

a deadbolt;

a cylinder-connecting portion formed with mounting provisions for mounting thereto a lock cylinder;

an actuator formed with a hub connectable to a lock cylinder, said hub being journaled in said cylinder-connecting portion;

a link bar that connects said actuator to said deadbolt at at least one of a plurality of attachment points formed on at least one of said deadbolt and said link bar;

a tube in which said deadbolt is slidingly disposed;

a strike attached to said tube defining a distance, called a backset, between an outer surface of said strike and a center of said hub; and a pin, placed between said tube and said cylinder-connecting portion, said pin being pushable inwards into a hole formed in said cylinder-connecting portion so as to release said tube from said cylinder-connecting portion and to allow said link bar to be moved from one of said plurality of attachment points to a different one of said plurality of attachment points, thereby adjusting said backset.

2. The deadbolt assembly according to claim 1 wherein when said tube is released from said cylinder-connecting portion, said cylinder-connecting portion, said actuator, said link bar and said deadbolt are removable from said tube.

3. The deadbolt assembly according to claim 1 wherein said deadbolt has a length such that said deadbolt extends to one of said mounting provisions when said link bar is attached to one of said attachment points.

4. The deadbolt assembly according to claim 1 wherein said mounting provisions are mounting holes spaced from one another corresponding to a spacing between mounting screws of a lock cylinder.

5. A method for adjusting an adjustable deadbolt assembly comprising:

providing a deadbolt assembly comprising:

a deadbolt;

a cylinder-connecting portion formed with mounting provisions for mounting thereto a lock cylinder;

an actuator formed with a hub connectable to a lock cylinder, said hub being journaled in said cylinder-connecting portion;

a link bar that connects said actuator to said deadbolt at at least one of a plurality of attachment points formed on at least one of said deadbolt and said link bar;

a tube in which said deadbolt is slidingly disposed;

a strike attached to said tube defining a distance, called a backset between an outer surface of said strike and a center of said hub; and a pin, placed between said tube and said cylinder-connecting portion, said pin being pushable inwards into a hole formed in said cylinder-connecting portion so as to release said tube from said cylinder-connecting portion and to allow said link bar to be moved from one of said plurality of attachment points to a different one of said plurality of attachment points; and moving said link bar from one attachment point to another, thereby adjusting said backset.

6. The method according to claim 5 and also comprising:

withdrawing said cylinder-connecting portion, said link bar, said actuator and said deadbolt from said tube;

moving said link bar from one attachment point to another; and sliding said cylinder-connecting portion, said link bar, said actuator and said deadbolt back into said tube.

7. A deadbolt assembly according to claim 1 and wherein said forward end of said tube is formed with a pair of oppositely disposed apertured lugs, positioned such that when the deadbolt assembly is mounted onto a door, apertures formed in the lugs lie along a vertical axis; and also comprising:

a mounting plate, pivotably mounted onto said tube about the vertical axis, said mounting plate being formed with mounting lugs having formed therein respective apertures;

a retaining spring having respective first and second engagement ends and being arranged to pivotably retain said mounting plate onto said tube, wherein said engagement ends extend through respective apertures of respective logs, thus defining pivot axles both of which preferably extend along said vertical axis, and wherein said faceplate is readily screwed onto said mounting plate and onto an edge of a door by means of mutually alienable screw holes formed in the faceplate which correspond to screw holes formed in the mounting plate.

8. The deadbolt assembly according to claim 1 wherein said backset varies from about 2.375 inches to about 2.75 inches.

9. An adjustable deadbolt assembly according to claim 1 wherein said tube includes a forward end through which said deadbolt emerges when extended and also comprising a faceplate pivotably connected to said forward end of said tube.

10. The deadbolt assembly according to claim 1 wherein said attachment points are notches formed on a periphery of said deadbolt.

11. The deadbolt assembly according to claim 1 wherein said attachment points are notches formed on said link bar.

12. The deadbolt assembly according to claim 1 wherein said link bar is formed with an aperture in which is received a portion of said actuator.

13. The deadbolt assembly according to claim 1 wherein said cylinder-connecting portion, said link bar, said actuator and said deadbolt are selectively removable from said tube.

* * * * *